US006070298A

United States Patent [19]

Sorimachi

[11] Patent Number: 6,070,298

[45] Date of Patent: Jun. 6, 2000

[54] COMPOSITE TORQUE HINGES

[75] Inventor: Akira Sorimachi, Yokohama, Japan

[73] Assignee: Ratoh Electrical Machinery Co., Ltd., Kanagawa, Japan

[21] Appl. No.: 08/957,120

[22] Filed: Oct. 24, 1997

[30] Foreign Application Priority Data

Oct. 28, 1996 [JP] Japan ..... 8-285704

[51] Int. Cl.[7] ..... E05F 1/02

[52] U.S. Cl. ..... 16/330; 16/303

[58] Field of Search ..... 16/306, 303, 337, 16/330

[56] References Cited

U.S. PATENT DOCUMENTS 571,133 11/1896 Hoffman ..... 16/303
4,215,449 8/1980 Loikitz ..... 16/303 X
5,109,571 5/1992 Ohishima et al. ..... 16/330 X
5,398,378 3/1995 Lin ..... 16/330 X
5,572,768 11/1996 Daul ..... 16/337 X

*Primary Examiner*—Lynne Reichard
*Assistant Examiner*—John R. Cottingham
*Attorney, Agent, or Firm*—Notaro & Michalos P.C.

[57] ABSTRACT

According to the invention, in order to obtain hinges which, even if small-sized, can create a great rotational torque and, moreover, permit ready alignment of details with the rotational moment of an opening/closing body, such as a lavatory seat or lid or accentuation of any part of the action thereof, there is provided a pair of composite torque hinges each consisting of; a rotating cylinder disposed to be rotatable around a fixed shaft; a cam mechanism which is provided within the rotating cylinder and on which a compression spring is caused to work so as to control the rotational torque of the rotating cylinder; and a torsion spring which is also provided within said rotating cylinder and functions in a direction to cancel the rotational torque of the rotating cylinder in a specific rotational direction.

2 Claims, 5 Drawing Sheets

COMPOSITE TORQUE HINGES

BACKGROUND OF THE INVENTION

1. Field of the Invention

The present invention relates to a pair of composite torque hinges especially suitable for use as an opening/closing device for opening/closing bodies such as seats, lids or the like of Western-styled lavatory stools.

2. Description of the Prior Art

As opening/closing devices for seats and lids of Western-styled lavatory stools, according to the prior art, what consists of a rotating shaft on which a cam mechanism having a compression spring is caused to act on, and what uses a torsion spring functioning in a direction to cancel the rotational torque working in a specific rotational direction of a rotating shaft are publicly known.

The known configuration consisting of a rotating shaft, on which a cam mechanism having a compression spring is caused to act, has the advantage that the created torque can be readily matched with the rotational moment of the seat or lid, but it also has the disadvantage that a large apparatus is needed to achieve a great rotational torque.

On the other hand, the known one which causes only a torsion spring to work on the rotation shaft, though having the advantage that a great rotational torque can be created even by a small mechanism, involves the disadvantage that it is difficult to match the rotational torque it creates, because it increases or decreases linearly, with the rotational moment of the seat or lid, which varies in a sine curve, and therefore to align details with the rotational moment of the seat or lid or to accentuate any part of the action thereof.

SUMMARY OF THE INVENTION

An object of the present invention is to provide a pair of composite torque hinges which, even if small-sized, can create a great rotational torque and, moreover, permit ready alignment of details with the rotational moment of an opening/closing body, such as a lavatory seat or lid or accentuation of any part of the action thereof.

In order to achieve the aforementioned object, according to the invention, there is provided a pair of composite torque hinges each consisting of a bracket; a fixed shaft engaged and fixed to this bracket; a rotating cylinder disposed to be rotatable around this fixed shaft; a cam mechanism which is provided within this rotating cylinder and on which a compression spring is caused to work so as to control the rotational torque of the rotating cylinder; and a torsion spring which is also provided within said rotating cylinder and functions in a direction to cancel the rotational torque of the rotating cylinder in a specific rotational direction.

In this configuration, according to the invention, the cam mechanism may be composed of a rotating cam which, letting the fixed shaft penetrate the central part thereof, is fixed to a diaphragm provided in the rotating cylinder; a sliding cam which, opposite to this rotating cam and letting the fixed shaft penetrate the central part thereof, can freely slide in the axial direction of this fixed shaft; and a compression spring which presses this sliding cam toward the fixed cam.

In each of the paired composite torque hinges according to the invention, the torsion spring may be elastically installed, wound around said fixed shaft, between a collar engaged to the fixed shaft and the rotating cylinder.

According to the invention, a protruding strip to stop turning may also be provided on part of the outer circumference of the rotating cylinder.

DETAILED DESCRIPTION OF THE PREFERRED EMBODIMENT

Figure 1:
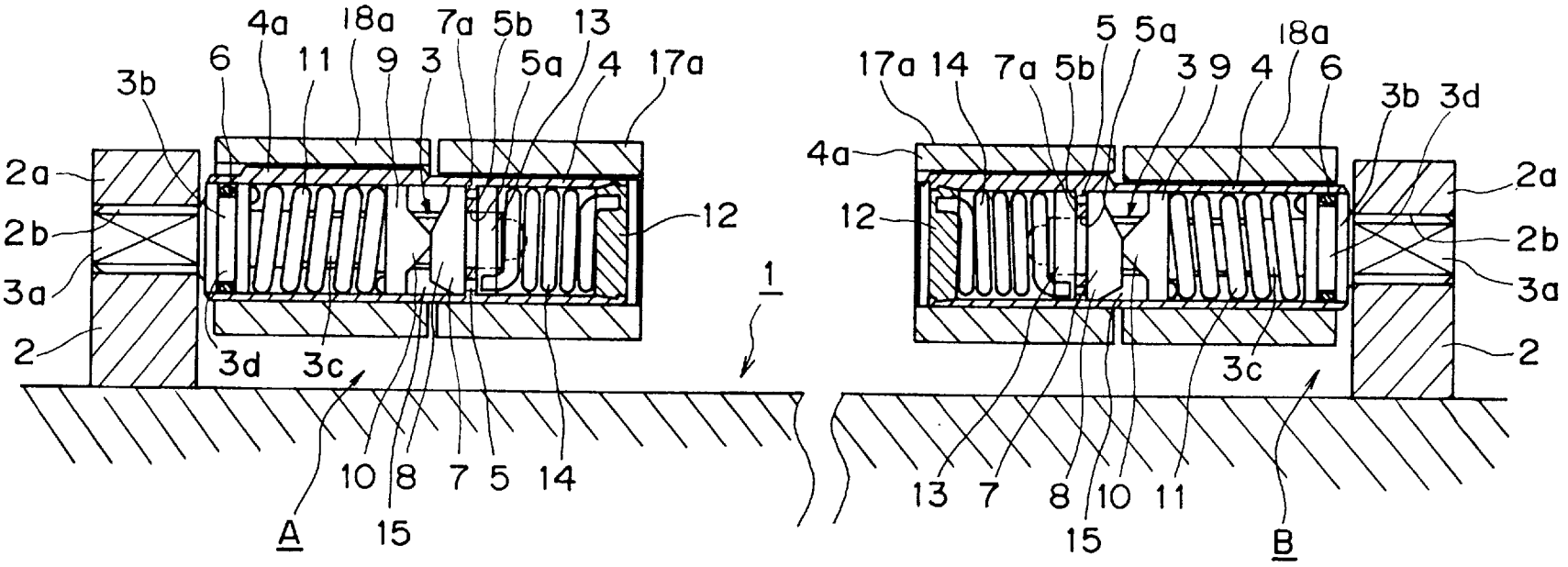
FIG. 1 is a diagram illustrating the use of a pair of composite torque hinges for opening and closing an opening/closing body such as the seat, lid or the like of a Western-styled lavatory stool.
Figure 2:
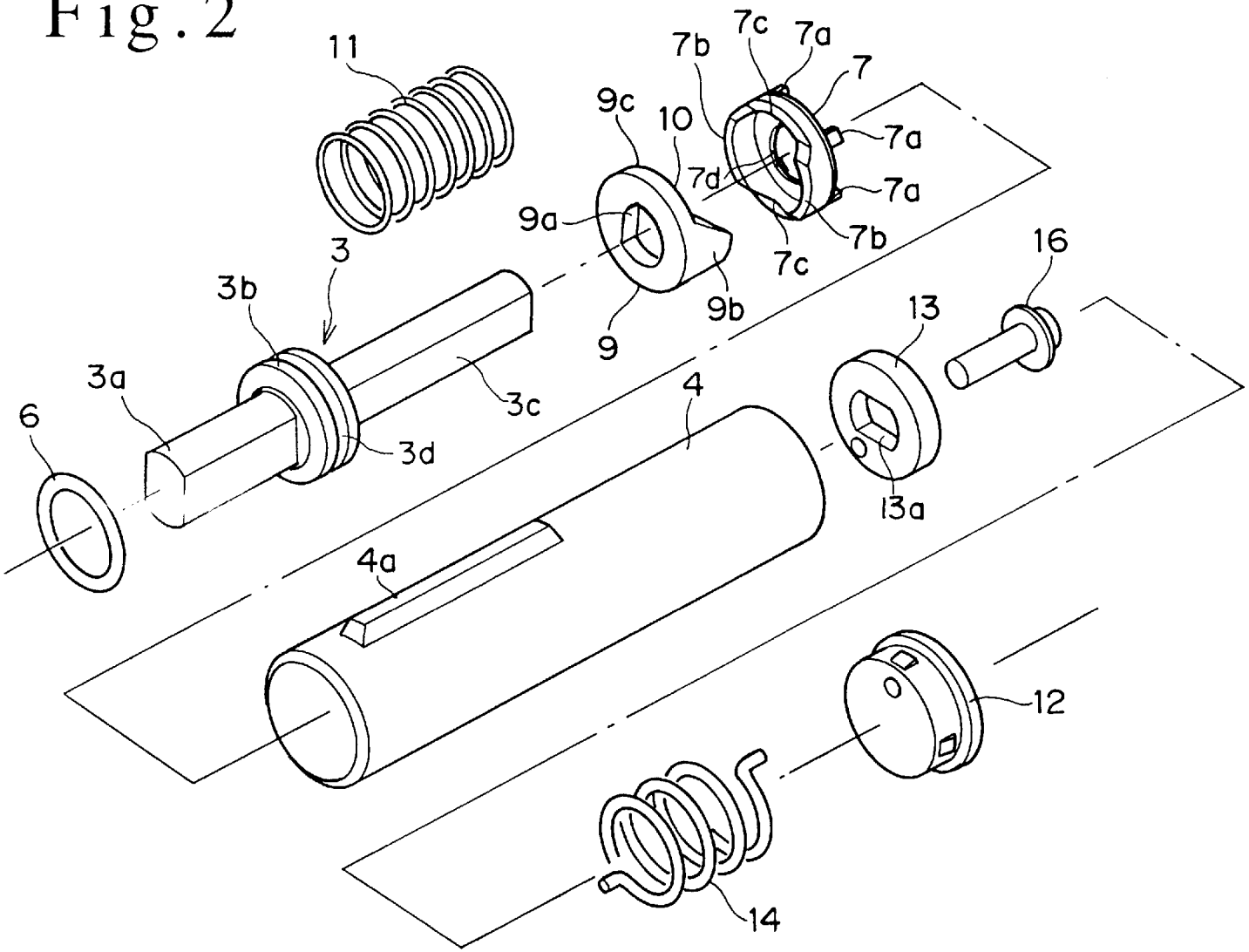
FIG. 2 is an exploded perspective view of one of the paired composite torque hinges illustrated in FIG. 1.
Figure 3:
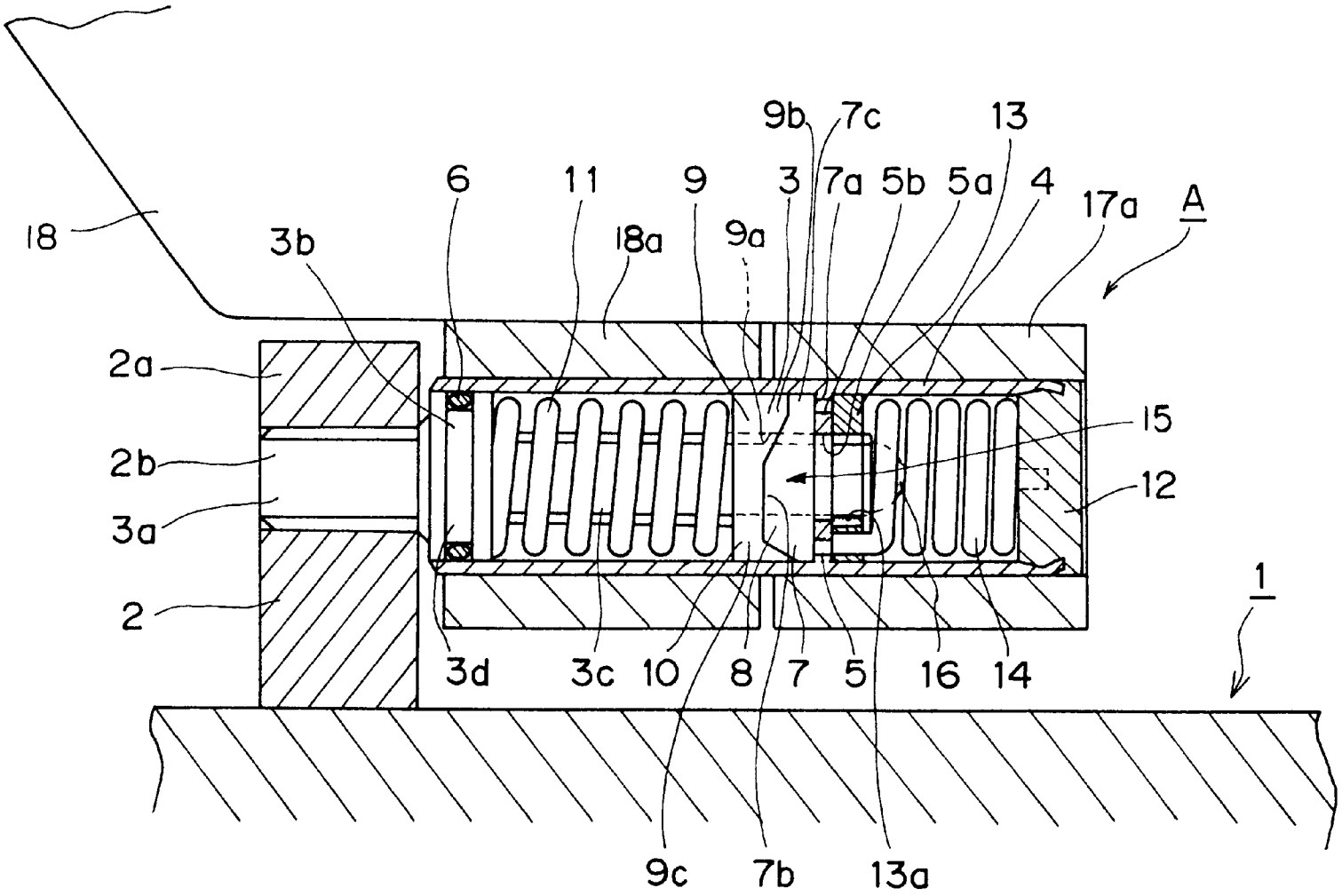
FIG. 3 is a diagram illustrating the action of a composite torque hinge A, one of the paired hinges illustrated in FIG. 1.
Figure 4:
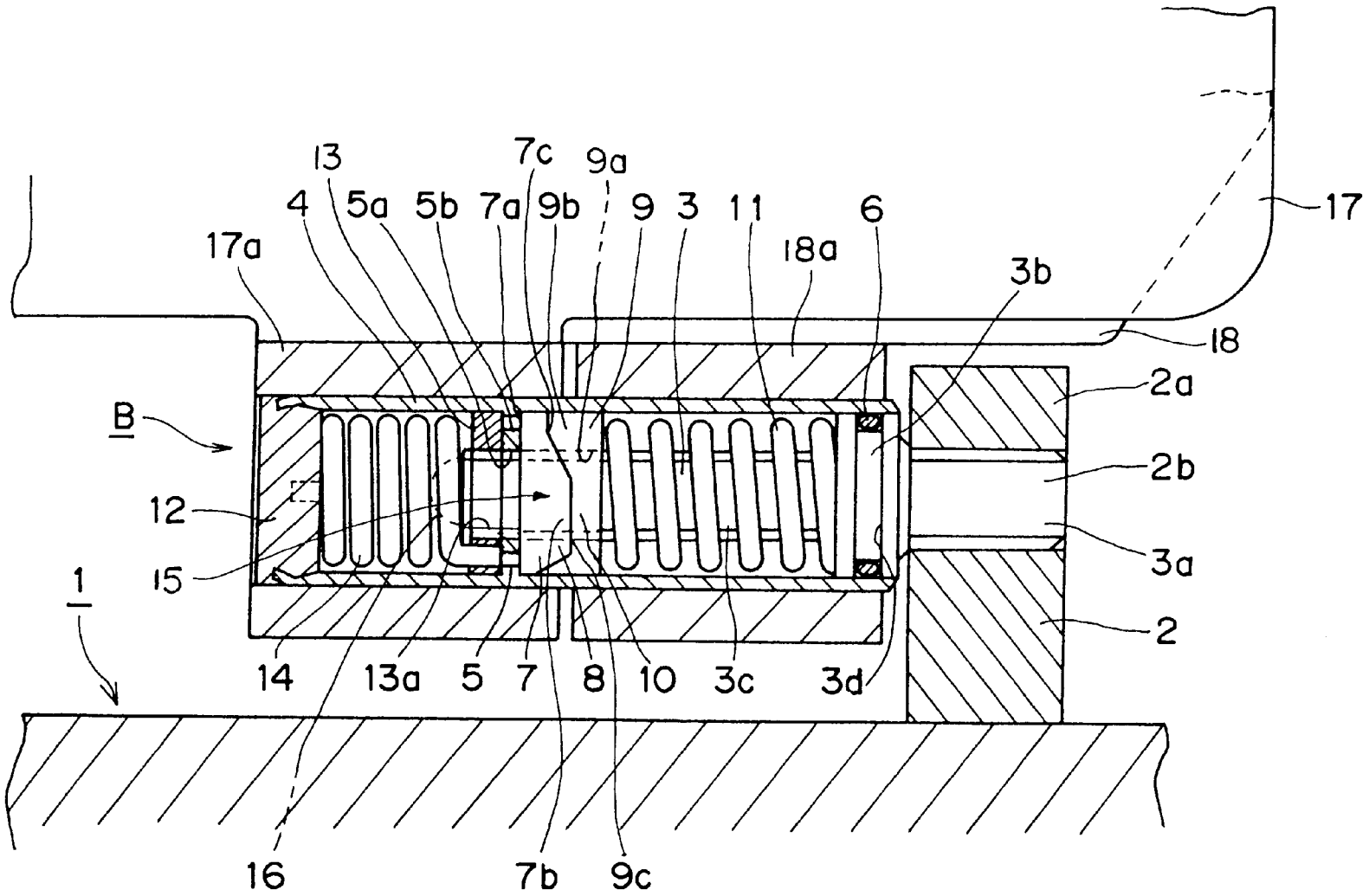
FIG. 4 is a diagram illustrating the action of a composite torque hinge B, one of the paired hinges illustrated in FIG. 1.

Whereas a preferred embodiment of the present invention, which represents an application thereof to an opening/closing body, such as the seat, lid or the like of a Western-styled lavatory stool, is described below, the invention is not limited to this embodiment, but is applicable to a wide variety of other opening/closing bodies.

In FIGS. 1 through 4, a pair of brackets 2 are fitted to the upper end of the rear part of a Western-styled lavatory stool 1 at a prescribed spacing between them, and deformed axial parts 3*a* provided at one end each of fixed shafts 3 are inserted and fixed in deformed holes 2*b* provided in bearing sections 2*a* of these brackets 2. The other parts of these fixed shafts 3 than the deformed axial parts 3*a* are housed in rotating cylinders 4, which are made freely rotatable around the fixed shafts 3 as, in each of the cylinders 4, the inlet part of the inner circumference is borne by a large diameter part 3*b*, disposed continuously from the deformed axial part 3*a* of the fixed shaft 3, and one end of a deformed small diameter part 3*c*, disposed continuously from the large diameter part 3*b*, is borne by a bearing hole 5*a* provided in a partition wall 5 within the rotating cylinder 4. Incidentally, between the outer circumference of each large diameter part 3*b* and the inner circumference of each rotating cylinder 4 is provided an O ring 6, fitted into a circumferential groove 3*d* provided in the large diameter part 3*b*. A pair of rotating cams 7 are fixed to the partition walls 5 provided within the rotating cylinders 4 by fitting a plurality of projections 7*a*, protruding from one side end of each of the cams 7, into a plurality of engaging holes 5*b* disposed around bearing holes 5*a* of the partition wall 5, and they rotate together with the rotating cylinders 4 by passing the deformed small diameter parts 3*c* of the fixed shafts 3 through penetrating holes 7*d* provided in the center of the rotating cams 7.

In positions opposite to cam parts 8 of these rotating cams 7 are fitted sliding cams 9, unrotatable but free to slide, allowing the deformed small diameter parts 3*c* of the fixed shafts 3 to pass deformed penetrating holes 9*a* provided in the center of the sliding cams 9, and their cam parts 10 are opposite to and in contact with the cam parts 8 of the rotating cams 7. In this way, the rotating cams 7 and the sliding cams 9 constitute cam mechanisms 15. Between each sliding cam 9 and each large diameter part 3*b*, a compression spring 11 is elastically installed, winding around the deformed small diameter part 3*c*.

On the other side of the partition wall 5 than where the rotating cams 7 are fitted, torsion springs 14 are housed, and they are caused to give a rotational force in one direction to the rotating cylinders 4 by engaging one end of each spring 14 to a lid 12 fitted unrotatably to the rotating cylinder 4 and the other end to the fixed shaft 3 by engaging it to a collar 13, which is fastened to the fixed shaft 3 with a fitting screw 16, with the fixed shaft 3 being caused to fit into a deformed hole 13*a* of the collar 13.

Fitting parts 17*a* and 18*a* of a lavatory 17 and a lavatory lid 18, respectively, are fitted to the outer circumference of the rotating cylinders 4. To a protruding strip 4*a*, projecting in the axial direction of the rotating cylinder 4 on the left side in FIG. 1 on its outer circumference, is engaged one of the fitting parts 18*a* of the lavatory lid 18, and one of the fitting parts 17*a* of the lavatory seat 17 is rotatably borne by the protruding strip 4*a*. A protruding strip 4*a* on the right side, similarly, rotatably bears the other of the fitting parts 18*a* of the lavatory lid 18, and the other of the fitting parts 17*a* of the lavatory seat 17 is engaged to that protruding strip 4*a*.

This configuration enables, when the lid 18 is to be opened or closed, the composite torque hinge A on the left side in FIG. 1 works to control that opening/closing action, and when the seat 17 is to be opened or closed, the composite torque hinge B on the right side serves to control that opening/closing action. In this embodiment, a major part of the falling moment of the opening/closing body, such as a lavatory seat, lid or the like, is borne by the torsion springs 14, and the detailed alignment or accentuation of the action or the like are performed by the cam mechanisms 15.

Figure 5:
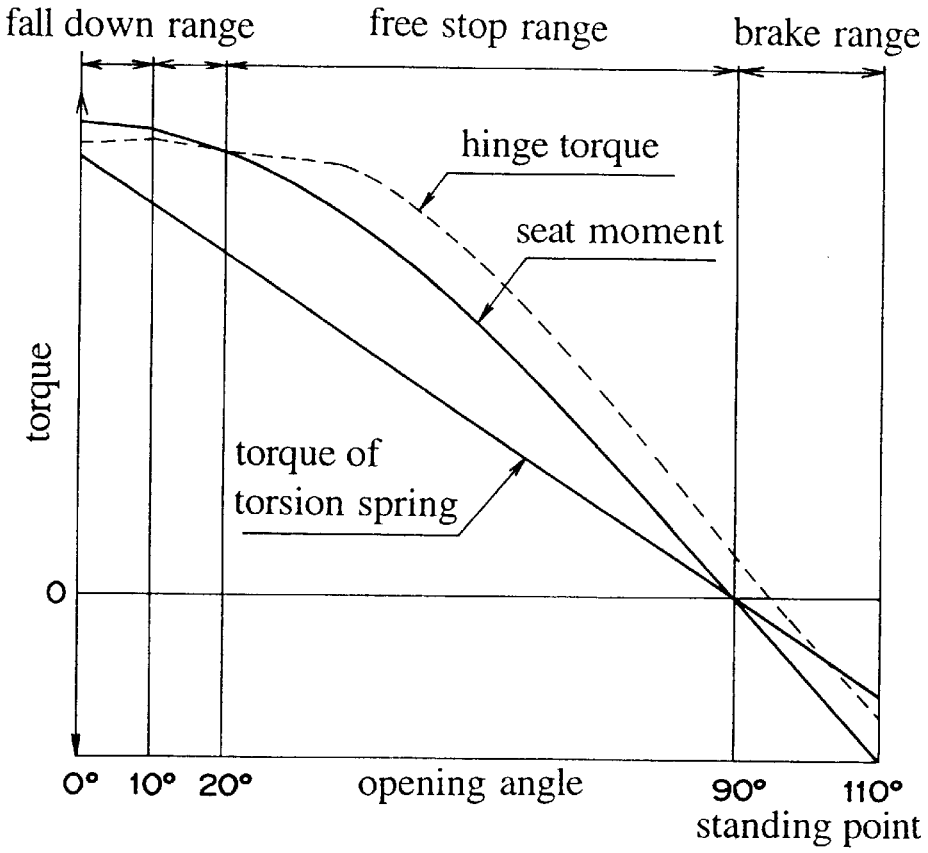
FIG. 5 shows the curves of torques generating where a pair of composite torque hinges according to the invention are used for opening and closing of an opening/closing body, such as the seat, lid or the like of a Western-styled lavatory stool.

FIG. 5 shows the curves of torques. According to this diagram, the torque curve of the torsion springs 14 crosses the opening/closing moment curve of the seat 17 in the 90° position of the seat 17. This torque curve, though always staying below the opening/closing moment curve of the seat 17 at an opening angle less than 90°, it is above the opening/closing moment curve of the seat 17 at any opening angle greater than 90°.

Figure 6:
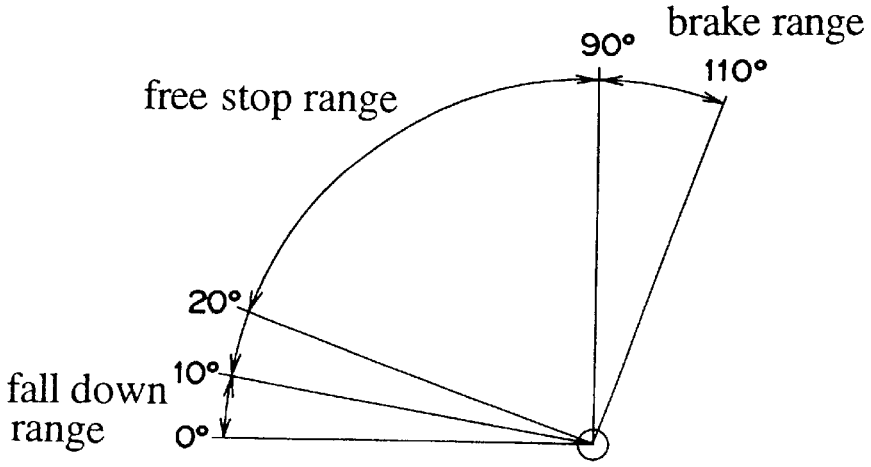
FIG. 6 is a diagram illustrating how the opening/ closing action is to be accentuated where a pair of composite torque hinges according to the invention are used for opening and closing an opening/closing body, such as the seat, lid or the like of a Western-styled lavatory stool.

FIG. 6 illustrates an actual example of how details are aligned or the action is accentuated with respect to the opening/closing moment of an opening/closing body, such as a lavatory seat, lavatory lid or the like by using the cam mechanisms 15 in which compression springs are brought into action. It is seen that various accentuations are possible by appropriately designing the torque of the torsion springs and the cam shape of the cam mechanisms.

Thus, when the lavatory seat 17 or the lavatory lid 18 is closed, as shown in FIG. 1, convex parts 7*b* of the rotating cams 7 are opposite to and in contact with convex parts 9*b* of the sliding cams 9, resulting in the most tightly compressed state of the compression springs 11. The torsion springs 14 are in a heavily wound state. When the seat 17 or the lid 18 is to be opened from this state, since the overall torque of the hinges is slightly below the opening moment of the opening/closing body, such as the lavatory seat or the like, as indicated in FIGS. 5 and 6, the user may feel some weight or resistance at the beginning of his or her opening action. However, above 20°, where the overall torque of the hinges begins to surpass the opening/closing moment of the opening/closing body, such as the lavatory seat or the like, it can be opened with only a little force and, in the opening angle range of up to 90°, the convex parts 7*b* of the rotating cams 7 and the concave parts 9*c* of the sliding cams are pressed against each other at the same time, concave parts 7*c* of the rotating cams 7 are opposite to the convex parts 9*b* of the sliding cams 9, letting the seat or the like be stopped in any desired position. When the self-standing angle of 90° is just surpassed, braking by the mutual pressing of the rotating cams 7 and the sliding cams 9 begins to work, and bouncing back or bounding is absorbed at the full-open angle of 110°.

When closing a fully open lavatory seat, lid or the like, it can again be stopped in any desired position in the range of opening angle between 90° and 20°, and as it is let go at an opening angle of 20°, the seat or the like will begin to close slowly and naturally drop from an angle of 10°.

What is claimed is:

1. A composite torque hinge comprising:

a bracket having a bearing section, the bracket fitted to an upper end of a rear part of a lavatory stool;

a fixed shaft having a deformed axial part, a large diameter part, a deformed small diameter part, and a collar fastened to the fixed shaft at the end opposide the deformed axial part, the fixed shaft being engaged and fixed to the bracket by the deformed axial part inserted through a deformed hole provided in the bearing section of the bracket;

a rotating cylinder having a partition wall defining a bearing hole provided in the rotating cylinder and a lid fixedly closing one end of the rotating cylinder, the rotating cylinder freely rotatably mounted around the fixed shaft and the large diameter part, the deformed small diameter part being rotatably inserted through the bearing hole;

a cam mechanism provided within the rotating cylinder for controlling the rotational torque of the rotating cylinder, the cam mechanism comprising:

a rotation cam mounted on the fixed shaft, the rotation cam connected to the partition wall;

a sliding cam axially slidably mounted on the fixed shaft in opposed relation to the rotation cam; and a compression spring mounted on the fixed shaft between the large diameter part and the sliding cam, the compression spring pressing the sliding cam toward the rotation cam; and a torsion spring provided within the rotating cylinder acting against a rotational torque of the rotating cylinder mounted on the fixed shaft between the collar and the lid.

2. A composite torque hinge according to claim 1, wherein the rotating cylinder further comprises a radially protruding strip oriented parallel with a longitudinal axis of the rotating cylinder on an outer circumference thereof, the protruding strip being engaged with a fitting part of a lavatory lid.

* * * * *